United States Patent [19]

Murza-Mucha et al.

[11] 4,106,548

[45] Aug. 15, 1978

[54] MASS FOR PRODUCTION OF CORES AND CASTING MOULDS

[75] Inventors: Paweł Murza-Mucha, Warsaw; Zbigniew Koszarewski, Raszyn; Wojciech Ostaszewski; Stanisław Pełsa, both of Warsaw, all of Poland

[73] Assignee: Politechnika Warszawska, Warsaw, Poland

[21] Appl. No.: 739,533

[22] Filed: Nov. 3, 1976

[51] Int. Cl.[2] ..... B22D 29/00

[52] U.S. Cl. ..... 164/132; 106/38.5 R; 106/38.9; 106/209; 106/214; 164/36

[58] Field of Search ..... 106/38.5 R, 38.35, 38.3, 106/38.9, 209, 214; 164/34, 35, 36, 132; 264/317

[56] References Cited

U.S. PATENT DOCUMENTS

| | | | |
|---|---|---|---|
| 2,212,557 | 8/1940 | Bauer | 106/214 |
| 3,196,505 | 7/1965 | Moren | 106/38.35 |
| 3,946,039 | 3/1976 | Walz | 164/34 |

*Primary Examiner*—Lorenzo B. Hayes

*Attorney, Agent, or Firm*—Haseltine, Lake & Waters

[57] ABSTRACT

Composition for production of cores and casting molds comprises 100 parts by weight of grain base, particularly quartz sand, 0.5 - 30 parts of alkal metal hydroxides, 1 - 40 parts of alkali metal carbonates, 1 - 15 parts of water as well as 0.2 - 10 of known hydrophilic binders. The composition according to the invention is removed from the cast or mold by subjecting the core in the cast or mold to the action of solvent, particularly water, preferably by dipping.

13 Claims, No Drawings

MASS FOR PRODUCTION OF CORES AND CASTING MOULDS

The invention relates to a composition for production of cores and casting molds.

The composition according to the invention finds its application in the production of casting cores and molds by all methods known in the founding industry.

Core sands and molding sands, generally used in the industry, are most often produced from quartz sand as well as binding agents. Binding agents can be of various types such as traditional oils, starches, clay and different combinations such as urea-formaldehyde resin possibly stabilized with amines or a phenol-formaldehyde-furfuryl resin. As a binder there have been known coal slime as well as a mixture of water glass with urea resin and kaolin. From among binders having the character of oils there have been known e.g. pine oil with the addition of paste starch or dextrin, vegetable oils or organic solvents possibly turpentine oil with resin-fatty acids as well as the combination of solid oxidation products of drying oils and elementary sulfur. There has been known a binding agent for cores and casting molds comprising per 100 parts by weight 50 - 80 parts by weight of bentonite, 50 - 80 parts of Portland cement, 3 - 12 parts of sodium carbonate, 1.5 - 6.5 parts of hydrated lime and 0.5 - 2 parts of aluminum hydroxide. The considerable variety of binders, used in the founding industry, added to the grain base indicates how extremely important is their proper selection, since both the further treatment of the composition e.g. hardening of cores and molds made from it, as well as the mechanical and technological properties depend on the type of binder. Some of the hitherto employed binding agents are expensive, inefficient or require a long hardening time in the core and molding sand. Cores and molds produced from the known compositions are characterized either by small resistance or by being very difficult to remove. This is especially true of cores. The hitherto employed methods of removing cores from castings consist in their mechanical shaking-out by means of e.g. grating shake-out, pneumatic jumpers and other devices, which are noisy and add dust to the air of the foundry. Moreover all core sands used up till now and some molding sands cannot be reused and are dumped, since their regeneration by existing methods is unprofitable.

The present invention was aimed at elimination of the disadvantages of known core and molding sands by providing a composition, so that cores and molds made from them exhibit high resistance and simultaneously can be easily removed not mechanically, at minimum labor cost without making a noise and dusting the air.

The composition for production of cores and casting molds according to the invention comprises per 100 parts by weight of grain base, particularly quartz sand, 0.5 - 30 parts of alkali metal hydroxides, preferably sodium hydroxide and/or potassium hydroxide, 1 - 40 parts of alkali metal carbonates, preferably sodium carbonate and/or potassium carbonate, 1 - 15 parts of water as well as 0.2 - 10 parts of known hydrophilic binders, preferably dextrin.

The cores and molds are made by the known method of sand hardening achieved by blowing $CO_2$ through the core in a core-box or the mold in a mold-box for 15-30 seconds for articles such as cylinder heads, longer for larger items.

Cores and molds produced from the mass according to the invention, as the conducted tests proved, reveal high abrasion resistance and are durable within the period of 4 weeks without decreasing their properties. After production of a core or mold from molding and core sand according to the invention, the core in the casting or mold are subjected to the action of a solvent, particularly water, preferably by dipping e.g. in a tank, where there occurs spontaneous crumbling of the core or mold during 2 - 6 minutes. Cores or molds, produced from compositions according to the invention, under the action of the temperature in a mold develop the capacity of absorbing a solvent. The absorbed solvent destroys the bonds of the composition in the core or mold. Since the removal of cores from castings by the method according to the invention becomes an operation which is extremely simple, inexpensive, safe and non-destructive castings. It is carried out without noise, caused in the hitherto used methods by the action of mechanical devices, and without dusting the air with particles of the composition. The surfaces of the castings after spontaneous removal of the core in water are characterized by exceptinal cleanness, without any residue of core sand grains. Core and molding sand when kept in water spontaneously undergo regeneration and can be reused.

The object of the invention is presented in much more by the following examples of the composition of core and molding sands, which do not limit its scope.

EXAMPLE I

Composition of the mass:

100 kg of quartz sand
1 kg of pale dextrin
6 kg of sodium carbonate
1.5 kg of sodium hydroxide
4.5 kg of water The mass is prepared in a roll mixer. The said mixer is charged with 100 kg of quartz sand and 1 kg of pale dextrin as well as 6 kg of sodium carbonate. The whole is mixed within 2 minutes. Separately there is prepared a solution comprising 1.5 kg of sodium hydroxide and 4.5 kg of water, which is next poured into the mixer without stopping the mixing. The operation of mixing is conducted for another 3 - 4 minutes.

From the prepared mass there is produced by the known method a core consisting of the inner shapes of the cylinder head. The core is hardened by blowing in a core box for 15 - 30 sec. with carbon dioxide. To the tank filled with water there is inserted a casting of the head, produced from an aluminum alloy together with a core reproducing the inner shape of the cylinder head. After 5 minutes of maintaining the head and core in water there occurs a complete crumbling of the core and the cast is taken out of the tank. The core sand remaining in the tank being highly cleaned from the binding agent is temporarily removed. The casting thus disposed of, its core does not require further cleaning of its inner surfaces.

EXAMPLE II

Composition of the mass:

100 kg of quartz sand
1 kg of pale dextrin
10 kg of sodium carbonate 3 kg of sodium hydroxide
5 kg of water The mass is prepared as in Example I.

In the table below there are presented properties of the core and molding sand according to the invention. The given properties relate to upper and lower values for the quoted examples.

TABLE

| Order number | Properties | After moulding and hardening | 3 hours after removing from core-box | After 6 hours | After 12 hours | After 24 hours | After slowing for 24 hours the following values become settled |
|---|---|---|---|---|---|---|---|
| 1 | Compressive strength RC, kG/om$^2$ | 3–10 | 30–90 | 50–85 | 40–60 | 30–50 | 25–40 |
| 2 | Bending strength Rg, kG/om$^2$ | 2–8 | 8–14 | 12–17 | 12–17 | 10–12 | 9–12 |
| 3 | Tensile strength Rr, kG/om$^2$ | 2–5 | 5–8 | 6–10 | 7–10 | 5–7 | 4–6 |
| 4 | Permeability P, $\frac{om^4}{G\ min}$ | 140–120 | 140–120 | 140–120 | 140–120 | 140–120 | 140–120 |

The content of hydroxides and carbonates has a substantial influence on the technical properties of an mass. With the increase of said components in the mass technical properties are improved, whereas the permeability of the mass decreases and time of crumbling of the mass in the solvent lengthens slightly.

We claim:

1. A composition for producing cores and casting molds consisting essentially of 100 parts by weight of sand, 0.5 to 30 parts by weight of at least one alkali metal hydroxide, 1 to 40 parts by weight of at least one alkali metal carbonate, 1 to 15 parts by weight of water and 0.2 to 10 parts by weight of a hydrophilic binder.

2. The composition of claim 1, in which the sand is quartz sand.

3. The composition of claim 1 in which the alkali metal hydroxide is selected from the group consisting of sodium hydroxide and potassium hydroxide.

4. The composition of claim 1 in which the alkali metal carbonate is selected from the group consisting of sodium carbonate and potassium carbonate.

5. The composition of claim 1 in which the hydrophilic binder is dextrin.

6. The composition of claim 1 wherein the alkali metal hydroxide is selected from the group consisting of sodium and potassium hydroxides, the alkali metal carbonate is selected from the group consisting of sodium and potassium carbonates and the hydrophilic binder is dextrin.

7. The composition of claim 1 hardened in the form of a core or casting mold.

8. The composition of claim 6 hardened in the form of a core or casting mold.

9. A core or casting mold hardened by blowing carbon dioxide through the composition of claim 6 in a core-box.

10. A method of separating the core or casting mold of claim 7 from a metal casting comprising subjecting the core or casting mold to the action of a solvent.

11. The method of claim 10 wherein the core or casting mold is immersed in the solvent.

12. The method of claim 10, wherein the solvent is water.

13. In the method of producing a metal casting by forming the casting in contact with a core or casting mold and subsequently removing the core or mold from the metal casting, the improvement comprising utilizing a core or casting mold formed from a molding sand consisting essentially of 100 parts by weight of sand, 0.5 to 30 parts by weight of at least one alkali metal hydroxide, 1 to 40 parts by weight of at least one alkali metal carbonate, 1 to 15 parts by weight of water and 0.2 to 10 parts dry weight of a hydrophilic binder and removing said core or casting mold from the metal casting by the action of a solvent.

* * * * *